US006896218B2

(12) United States Patent
Gay et al.

(10) Patent No.: US 6,896,218 B2
(45) Date of Patent: May 24, 2005

(54) INSTALLATION AND METHOD FOR CONDITIONING A SHEET OF MOULDING MATERIAL

(75) Inventors: Jean-Louis Gay, Tournon (FR); Christian Four, Colombier-le-Vieux (FR)

(73) Assignee: Mixt Composites Recyclables, Tournon (FR)

( * ) Notice: Subject to any disclaimer, the term of this patent is extended or adjusted under 35 U.S.C. 154(b) by 85 days.

(21) Appl. No.: 10/344,513

(22) PCT Filed: Sep. 5, 2001

(86) PCT No.: PCT/FR01/02755

§ 371 (c)(1),
(2), (4) Date: Feb. 12, 2003

(87) PCT Pub. No.: WO02/20385

PCT Pub. Date: Mar. 14, 2002

(65) Prior Publication Data

US 2003/0173449 A1 Sep. 18, 2003

(30) Foreign Application Priority Data

Sep. 6, 2000 (FR) ..... 00 11360

(51) Int. Cl.[7] ..... B65H 19/22

(52) U.S. Cl. ..... 242/533; 242/533.8

(58) Field of Search ..... 242/533.8, 530, 242/530.4, 533, 547

(56) References Cited

U.S. PATENT DOCUMENTS

| | | | | |
|---|---|---|---|---|
| 3,818,737 A | | 6/1974 | Kajiwara | |
| 4,346,852 A | * | 8/1982 | Kawada et al. | 242/530.4 |
| 4,875,632 A | * | 10/1989 | Kataoka | 242/530 |
| 5,727,747 A | * | 3/1998 | Hannen et al. | 242/533.8 |
| 5,794,885 A | * | 8/1998 | Husek et al. | 242/533.8 |

FOREIGN PATENT DOCUMENTS

| | | |
|---|---|---|
| DE | 3016911 | 11/1981 |
| DE | 4009041 | 9/1991 |

* cited by examiner

*Primary Examiner*—William A. Rivera
(74) *Attorney, Agent, or Firm*—Dowell & Dowell , P.C.

(57) ABSTRACT

An installation for winding sheets of molding materials exiting a machine wherein at least two coil devices are provided at space locations horizontally with respect to an exit of the machine, and wherein the sheet material is directed to the coils by way of a horizontally movable carriage including a main frame and a secondary frame, which is adjustable horizontally relative to the main frame, and which carriage is movable horizontally to direct the sheet material to a selected one of the at least two coils.

10 Claims, 8 Drawing Sheets

INSTALLATION AND METHOD FOR CONDITIONING A SHEET OF MOULDING MATERIAL

BACKGROUND OF THE INVENTION

1. Field of the Invention

The invention relates to an installation and to a method for conditioning a sheet of moulding material on coils at the exit of a machine for producing a moulding material in sheet form.

2. Brief Description of the Related Art

Such a material, commonly called "SMC" (Sheet Moulding Compound) is produced continuously on a machine which may be of type known from FR-A-2 778 360 or of any other type. Such a machine functions without interruption and a system must be provided for conditioning the sheet of SMC produced, this system being compatible with the speed of advance of the sheet at the exit of the machine. When coils adapted to receive about 300 to 700 kg of material are used, it is possible to employ a system incorporating rocker provided with two mandrels supporting the coils, the material being alternately wound on each of these mandrels.

However, for at least certain applications, it is necessary to provide the use of large-capacity coils, such coils not being able to be manipulated by a system incorporating rocker, due to their weight and dimensions.

SUMMARY OF THE INVENTION

It is a more particular object of the invention to overcome this problem by proposing a novel installation which is compatible with the continuous functioning of an SMC producing machine and with the use of coils of considerable mass and diameter.

In this spirit, the invention relates to an installation of the afore-mentioned type, which comprises:

at least two locations for positioning coils winding the sheet of SMC, such locations being in succession in a substantially horizontal direction, a carriage constituted by a main frame and a secondary frame, provided with rollers guiding the sheet and mobile in translation, in the afore-mentioned direction, between a first position located substantially above a first location and a second position located substantially above the second location, and reciprocally, the main and secondary carriages being adapted to slide with respect to each other parallel to the afore-mentioned horizontal direction.

Thanks to the invention, the use of two successive locations makes it possible to provide, for each location, adapted means for supporting and driving the web of moulding material, while the carriage makes it possible to take the sheet of moulding material up to each of the coils respectively installed in each of these locations. The bipartite nature of the carriage of the invention makes it possible to vary its length parallel to the horizontal direction of advance of the sheet. It is thus possible to provide a compact configuration of this carriage, for example when it is not used, and an extended position which allows it to guide the sheet of moulding material over a relatively considerable length. The conditions of support of the sheet at the exit of the moulding material producing machine may thus be optimized.

According to advantageous aspects of the invention, the installation incorporates one or more of the following characteristics:

The carriage is equipped with a device for driving the sheet, this device being mobile, concomitantly to the employment of sheet cutting means, between a position of engagement with the sheet and a position disengaged with respect thereto. In particular, this device may be provided to comprise a frame supporting a motorized roller and a follower roller, these rollers each being centered on an axis substantially perpendicular to the direction of advance of the sheet and surrounded by a drive belt, while this frame is articulated on the carriage about an axis substantially perpendicular to this direction, between a first position where the belt is in contact with the sheet and a second position where the belt is remote from the sheet, and vice versa.

The carriage is equipped with a cutting device mounted on a frame articulated on the carriage about an axis substantially perpendicular to the direction of advance of the sheet. The cutting device may therefore be activated by its frame pivoting about its axis of articulation.

The carriage is equipped with a terminal guiding device extending, in configuration of use of the carriage, in the direction of a coil in the course of being filled, the guiding device being articulated on the carriage about an axis substantially perpendicular to the direction of advance of the sheet. The articulated nature of this guiding device makes it possible to retract it when the carriage is not being used.

The main and secondary frames are equipped with rollers for supporting the sheet in its movement of advance.

The carriage is adapted to be displaced towards a standby position where it does not interfere with the path of the sheet. This aspect of the invention makes it possible to use an SMC producing machine both to produce coils of SMC of considerable weight, greater than 1000 kg, and coils of SMC of the order of 300 to 700 kg, such as known previously.

Each coil is mounted in a principal chassis in which it is adapted to rest, by the peripheral edges of its end plates, on blocking shoes, while the principal chassis is adapted to be placed on an auxiliary chassis equipped with rollers adapted to lift the afore-mentioned edges with respect to the shoes when the principal chassis is placed on the auxiliary chassis. The use of these two chassis makes it possible to provide a blocking by default of a coil inside the principal chassis thanks to the use of the shoes, such blocking being eliminated when the coil and the principal chassis are placed on the auxiliary chassis, the idly mounted rollers making it possible to support the end plates of the coil with a possibility of rotation.

The auxiliary chassis is equipped with wheels allowing it to slide in a direction substantially perpendicular to the direction of advance of the sheet. This transverse access makes it possible to carry out the operations of positioning and of evacuation of the coils in masked time.

The invention also relates to a method of conditioning which may be carried out with the installation described hereinbefore and, more specifically, to a method which comprises the steps consisting in using two types of coils of different diameter at the exit of the machine, depending on the quantity of matter to be wound, while when coils of relatively smaller diameter are used, they are supported by a rocker disposed opposite the exit zone of the machine, and when coils of relatively larger diameter are used, a coil adapted to be driven in rotation is installed in at least one of two locations for positioning coils located downstream of the rocker with respect to a direction of advance of the sheet, a mobile carriage is disposed, substantially above the coil, provided with guiding rollers on or against which the sheet was previously arranged, the sheet is driven from the carriage in order to displace the front edge of this sheet up to contact with the mandrel of the coil, the coil is driven in rotation until the desired quantity of material is wound, the sheet is cut in the vicinity of the carriage, and the carriage is displaced up to above the second location in which a second coil was previously installed.

A BRIEF DESCRIPTION OF THE DRAWINGS

The invention will be more readily understood and other advantages thereof will appear more clearly in the light of the following description of a form of embodiment of an installation in accordance with its principle and of its method of functioning, given solely by way of example and made with reference to the accompanying drawings, in which.

DESCRIPTION OF THE PREFERRED EMBODIMENTS

The installation according to the invention is arranged at the exit of a machine 1 for producing composite moulding material of SMC type, in the form of a sheet 2 circulating along a path represented by arrows $F_1$ in the Figures. The machine 1 is equipped with a "jumping jack" element 3 for compensating the variations in length and speed of advance of the sheet 2.

Figure 8:
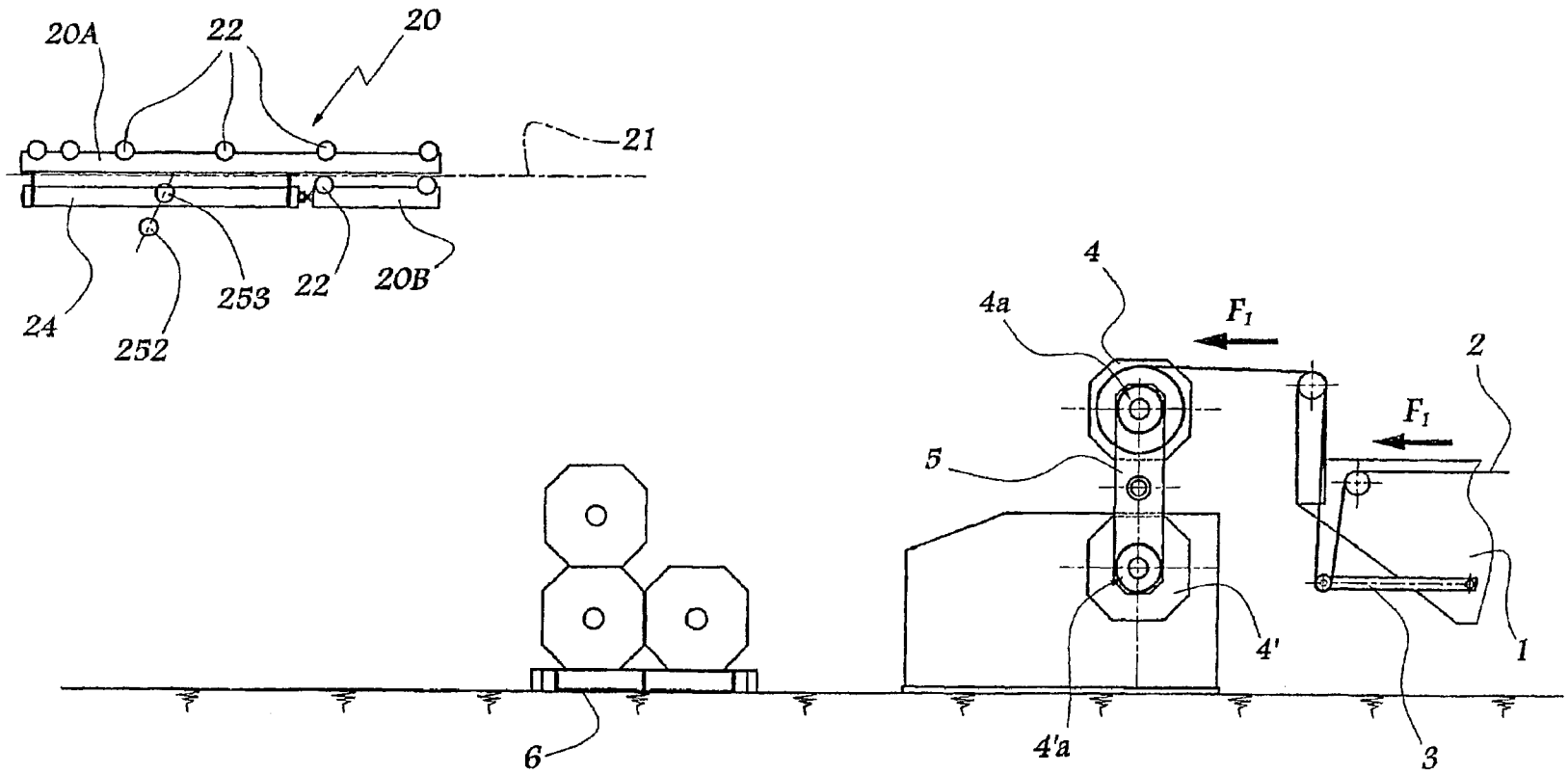
FIG. 8 is a view similar to FIGS. 1 and 2 in another configuration of use of the installation.

As is more particularly visible in FIG. 8, the sheet 2 may be wound over the mandrel 4*a* or 4'*a* of coils 4 and 4' supported by the arms of a rocker 5 disposed opposite the exit zone of the machine 1. In the configuration shown in FIG. 8, the sheet 2 is in the course of being wound on the coil 4, while coil 4' may be either loaded on the rocker 5, or unloaded therefrom before being stored on a transport pallet 6 disposed in the vicinity. This use of the machine 1 corresponds to the known state of the art.

When the coils 14 and 14' of large diameter d are to be used, particularly for winding the sheet 2 in quantities greater than 1000 kg, two locations 15 and 15' are used, successively provided to the rear of the rocker 5 in a substantially horizontal direction X–X' of advance of the sheet 2 after it has left the machine 1. These locations 15 and 15' are accessible in two directions $Y_1$–$Y'_1$, $Y_2$–$Y'_2$ substantially perpendicular to direction X–X'.

The direction X–X' is substantially parallel to the path $F_1$ of the sheet 2 in its upper part, after it has left the machine 1.

Figure 3:
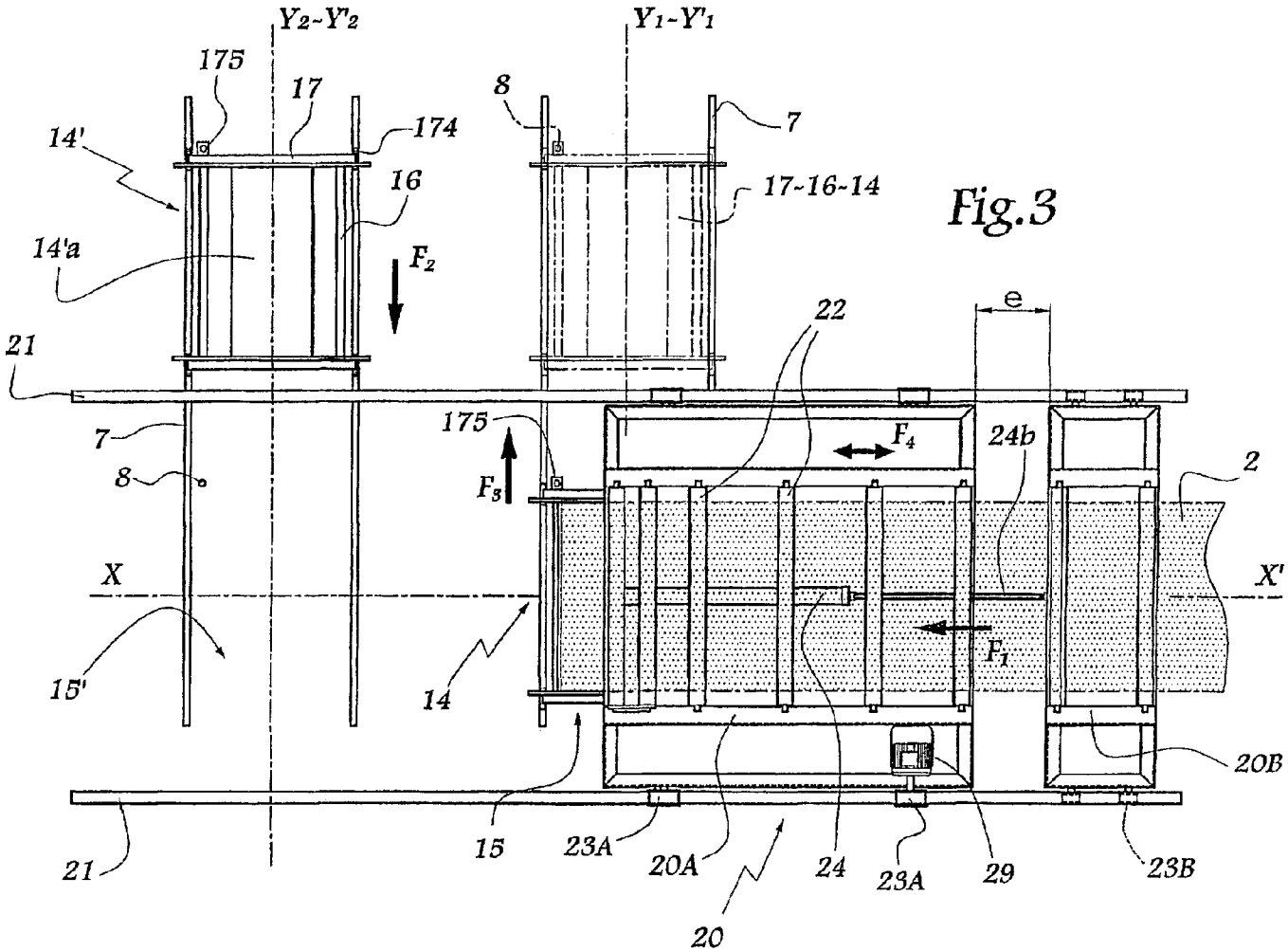
FIG. 3 is a plan view of the installation in the configuration of FIG. 1.

In this way, and as is visible in FIG. 3, it is possible to position an empty coil 14' in the location 15' by a translation in the direction of the arrow $F_2$ in FIG. 3, this arrow being parallel to direction $Y_2$–$Y'_2$. When coil 14 is filled, it is possible to remove it, as represented by arrow $F_3$ which is parallel to direction $Y_1$–$Y'_1$. In this way, an intervention $F_2$ or $F_3$ on one of the coils 14 or 14' has no influence on the coil 14' or 14 located in an adjacent location 15' or 15.

A carriage 20 rests on rails 21 above the rocker 5 and the locations 15 and 15'. This carriage is equipped with a plurality of rollers 22 making it possible to support the sheet 2 in its movement of advance $F_1$, these rollers being mounted idly on two frames, namely a main frame 20A and a secondary frame 20B each provided with wheels 23A, 23B respectively, allowing them to slide along the rails 21, as represented by arrow $F_4$. The wheels 23A rest on the rails 21 while wheels 23B, which are located at the right height for the frame 20B disposed at a level lower than that of frame 20B, rest on the lower flanges of the rails 21 which have a substantially C-shaped cross-section.

An electric motor 29 drives certain wheels 23A for the displacement of the carriage 20 on the rails 21. The motor 29 is controlled by the monitoring unit of the machine 1.

A jack 24 is mounted on the main frame 20A. The secondary frame 20B is fast with the rod 24*b* of the jack 24, with the result that the distance e between the frames 20A and 20B may be adjusted by means of the jack 24.

The total length L of the carriage 20 is provided to be sufficient for the sheet 2 to be efficiently guided, forming a substantially horizontal and planar web on the rollers 22. In this way, the length of the carriage 20 may be adjusted thanks to the jack 24, as a function of the characteristics of the sheet 2, these characteristics being able to vary due to its composite nature. The adjustment of the length of the carriage 20 also makes it possible to adjust the tension of winding of the sheet 2.

On the contrary, when the carriage 20 is not used, as shown in FIG. 8, the jack 24 is retracted in order to reduce the total dimensions of the carriage 20 parallel to direction X–X'.

20C denotes the edge of the carriage 20 which extends, perpendicularly to direction X–X', opposite the machine 1.

When the coil 14 is to be filled, the carriage 20 is positioned on the rails 21 so that its edge 20C is disposed substantially above the coil 14. In this way, that part 2*a* of the sheet 2 stretched between the carriage 20 and the coil 14 extends in a plane only slightly inclined with respect to the vertical. The part 2*a* of the sheet 2 coming from the carriage 20 may therefore be easily wound on the mandrel 14*a* of the coil 14 suitably driven in rotation in the direction of arrow R.

A device 25 for guiding the part 2*a* of the sheet 2 is constituted by a frame 251 articulated on the frame 20A about an axis $Y_{25}$ substantially perpendicular to the direction X–X'. This frame bears, at its end opposite axis $Y_{25}$, two rollers 252 and 253 defining therebetween a slot 254 for passage of the sheet 2. The frame 251 also supports a plate 255 which extends over the whole width of the carriage 20. The position of the frame 251 about axis $Y_{25}$ is controlled thanks to two jacks represented by their axis lines 256 articulated on the frame 20A and of which the rod is fast with the frame 251.

Figure 4:
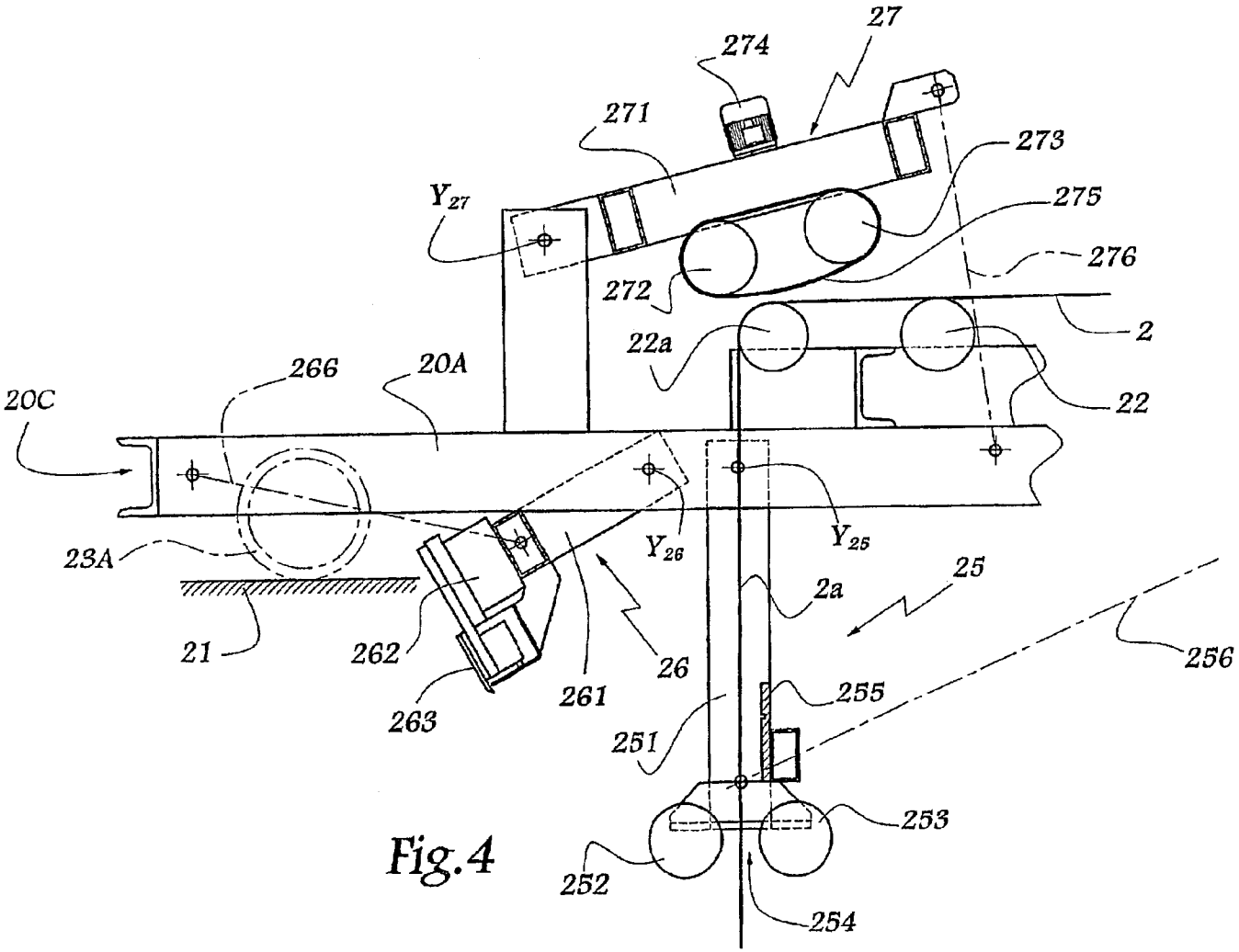
FIG. 4 is a longitudinal section on a larger scale of a part of the carriage used in the installation of FIGS. 1 to 3.
Figure 5:
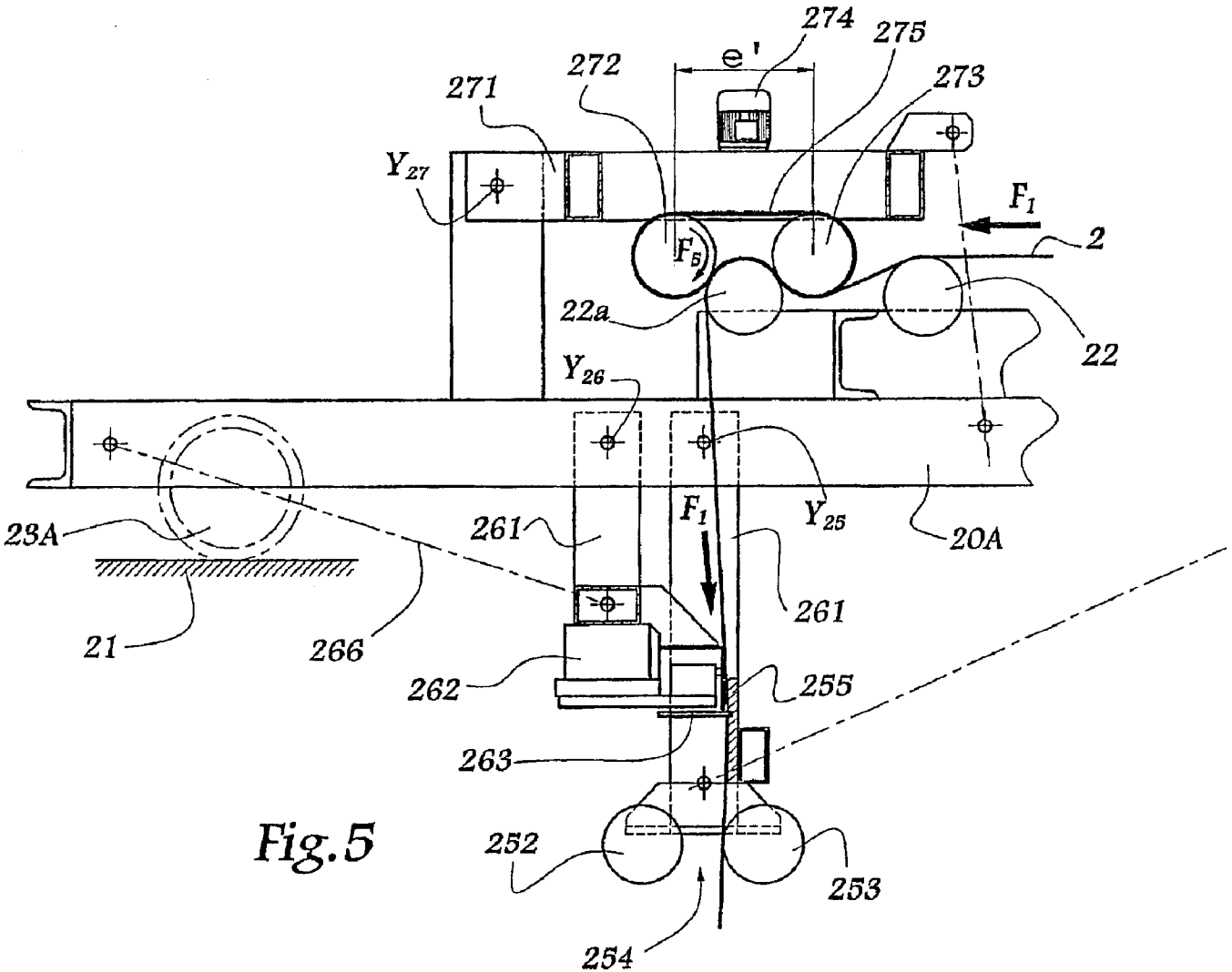
FIG. 5 is a section similar to FIG. 4 while the installation is in another configuration of use.

The frame 251 remains in the position shown in FIGS. 4 and 5 except when the carriage 20 is not used, as in the configuration of FIG. 8, in which case the jacks 256 are contracted in order to return the rollers 252 and 253 up to the immediate vicinity of the frame 20A in order to reduce the dimensions of the carriage 20.

A cut-out device 26 is articulated on the frame 20A about an axis $Y_{26}$ substantially parallel to axis $Y_{25}$, i.e. perpendicular to the direction X–X'. The device 26 comprises a frame 261 supporting a rodless jack 262 controlling a blade 263. Two jacks represented by their axis lines 266 are articulated on the chassis 20A and make it possible to control pivoting of the frame 261 about axis $Y_{26}$.

During filling of the coil 14, the device 26 is in the position of FIG. 4 where it does not interfere with the sheet 2. When the coil 14 has been filled, the jacks 266 are activated in order to bring the frame 261 into the configuration of FIG. 5 where the blade 263 is in contact with the sheet 2. The jack 262 then displaces the blade 263 along the plate 255, thus cutting the sheet 2.

It is then possible to proceed with the final winding of the sheet 2 on the coil 14.

When the sheet 2 has been cut, it no longer undergoes any effort of tension due to the movement of rotation of the coil 14. It should therefore be avoided that the sheet 2 sets off again in the direction of the machine 1 under the effect of the elastic effort exerted by the element 3. To that end, the carriage 20 is equipped with a device 27 for driving and blocking the sheet 2 which comprises a frame 271 articulated about an axis $Y_{27}$ on the frame 20A and of which the displacement is controlled thanks to two jacks represented by their axis lines 276. The frame 271 supports a first roller 272 which extends parallel to the rollers 22 and to the axis $Y_{27}$ and which is motorized thanks to an electric motor 274. The frame 271 also supports a second roller 273 mounted idly and parallel to the roller 272. A belt 275 formed by metal links is stretched around the rollers 272 and 273 and may be set into motion by the controlled rotation of the roller 272.

22*a* denotes the roller supported by the frame 20A and disposed as close as possible to the edge 20C, i.e. the roller 22 which is the last on the path of the sheet 2.

Concomitantly to the displacement of the frame 261, the frame 271 is displaced in the direction of the frame 20A by the jacks 276, so that the belt 275 is firmly applied against the sheet 2 in abutment on the roller 22*a*. The distance e' of rollers 272 and 273 is chosen so that the roller 22*a* may be partially engaged between the rollers 272 and 273, as represented in FIG. 5. In this configuration, the belt 275 acts like a brake to a possible movement of withdrawal of the sheet 2 in the direction opposite to arrows $F_1$. To that end, the motor 274 may be blocked. This motor is equipped with a gear motor thus increasing the value of the load moment, this preventing the return of the sheet 2.

When the sheet 2 has been cut by the blade 263, the carriage 20 is displaced so that its edge 20C lies substantially above the coil 14' which was positioned in the location 15' in parallel to the winding of the sheet 2 on the coil 14. From this configuration, the motor 274 is activated so that the roller 272 is driven in the direction of arrow $F_5$ in FIG. 5, which has the effect, taking into account the pressure exerted by the jack 276 and the firm abutment of the belt 275 on the sheet 2, of driving the sheet 2 in the direction of arrows $F_1$, so that its free edge which was previously located at the level of the plate 255 progresses in the direction of mandrel 14'*a* of the coil 14' around which the sheet 2 then begins to be wound. The coil 14' is then rotated and the jacks 275 are activated in order to move the belt 275 away from the sheet 2.

Figure 1:
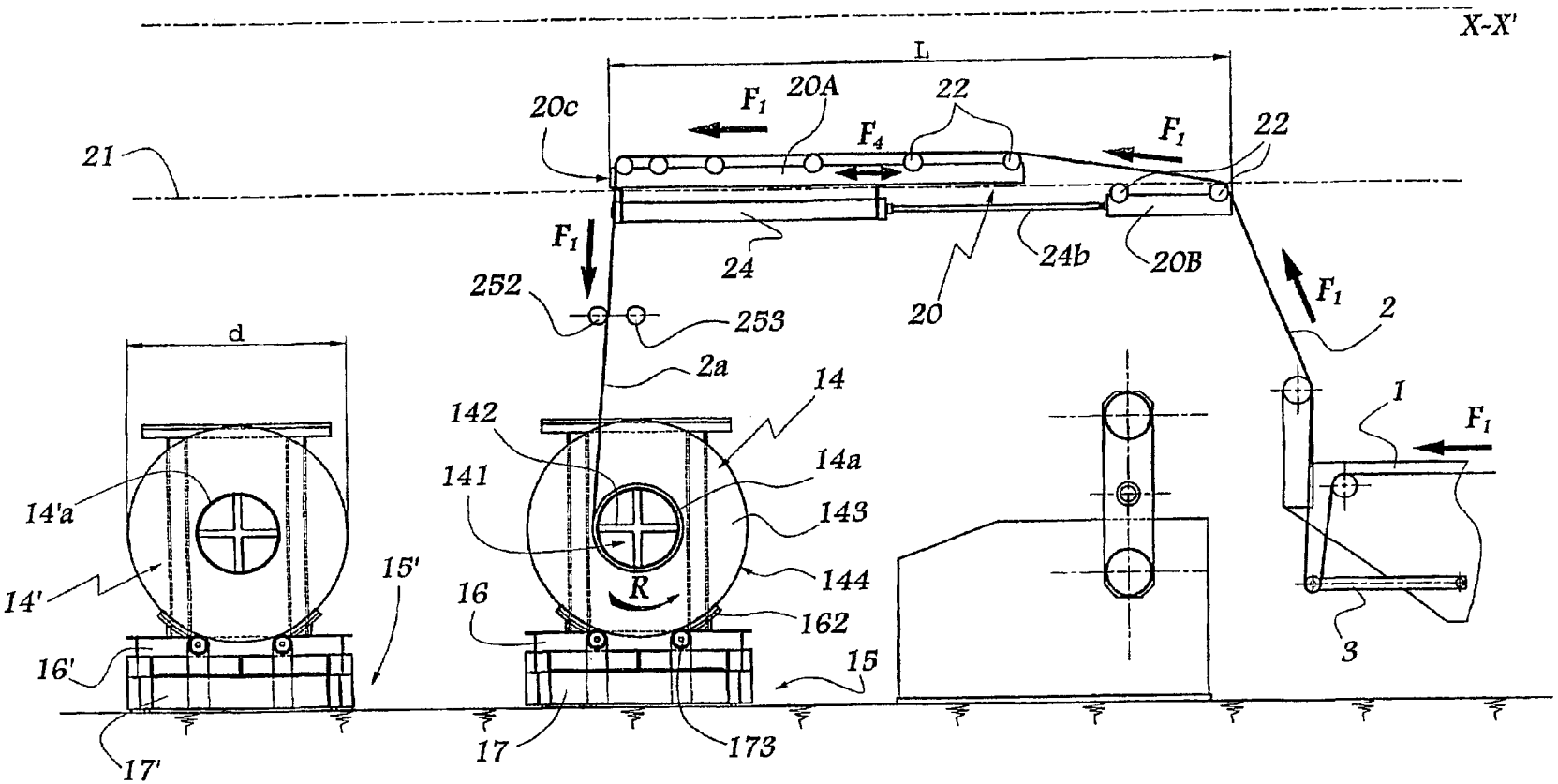
FIG. 1 is a schematic representation of an installation according to the invention in a first configuration of use.
Figure 2:
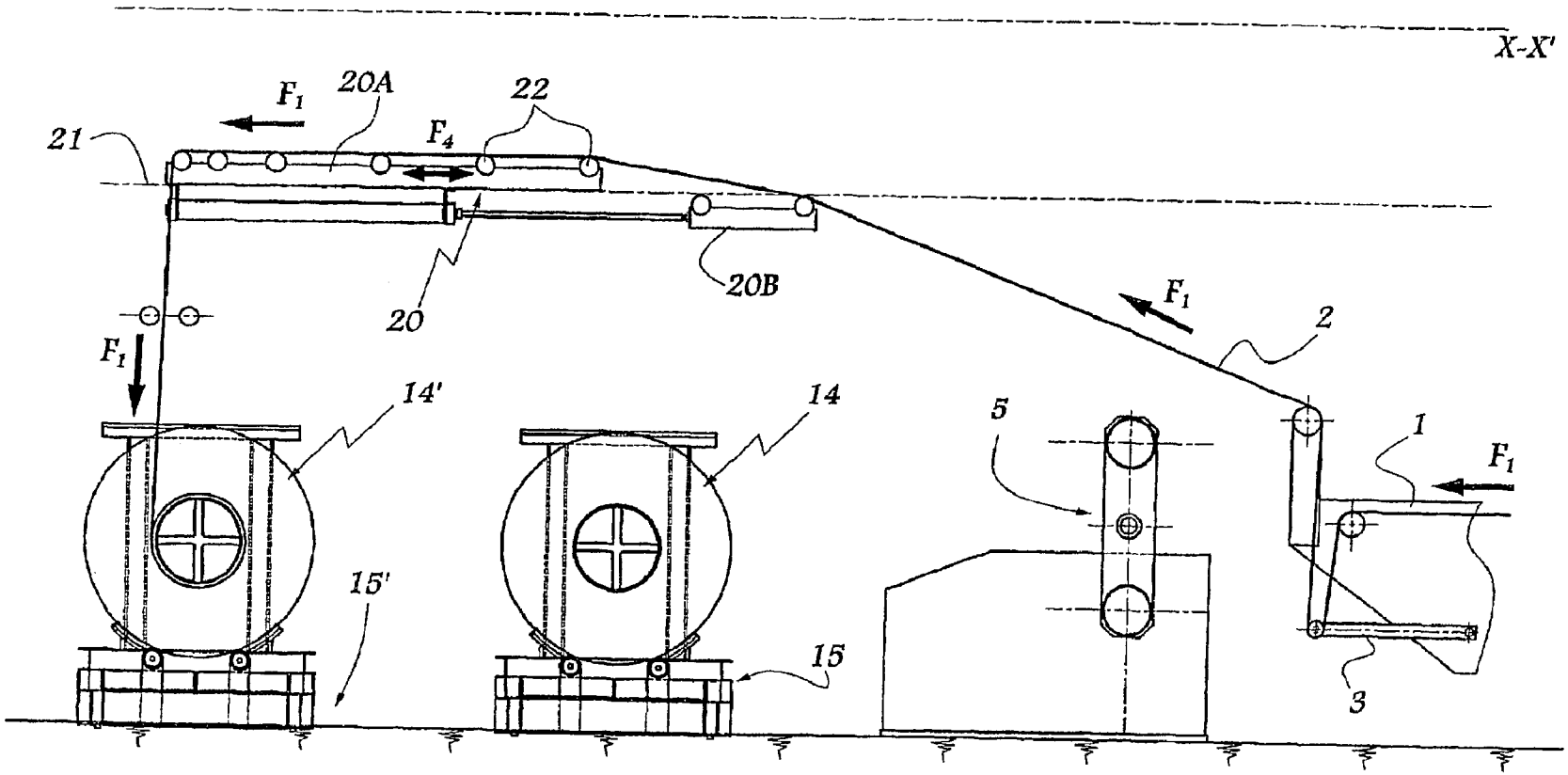
FIG. 2 is a view similar to FIG. 1 while the installation is in a second configuration of use.

One is then in the position of FIG. 2 where the filling of the coil 14' may take place, while the coil 14 may be evacuated in the direction of arrow $F_3$ in FIG. 3.

During the filling of coil 14', the coil 14 is evacuated and a fresh coil is placed in position. When the coil 14' is full, one proceeds as indicated hereinabove for the coil 14 and the carriage 20 is returned above the location 15.

In this way, continuous functioning of the installation can be envisaged.

In order to render the drawings clearer, devices 25 to 29 have been omitted from FIGS. 1 to 3 and 8, except for rollers 252 and 253.

Figure 6:
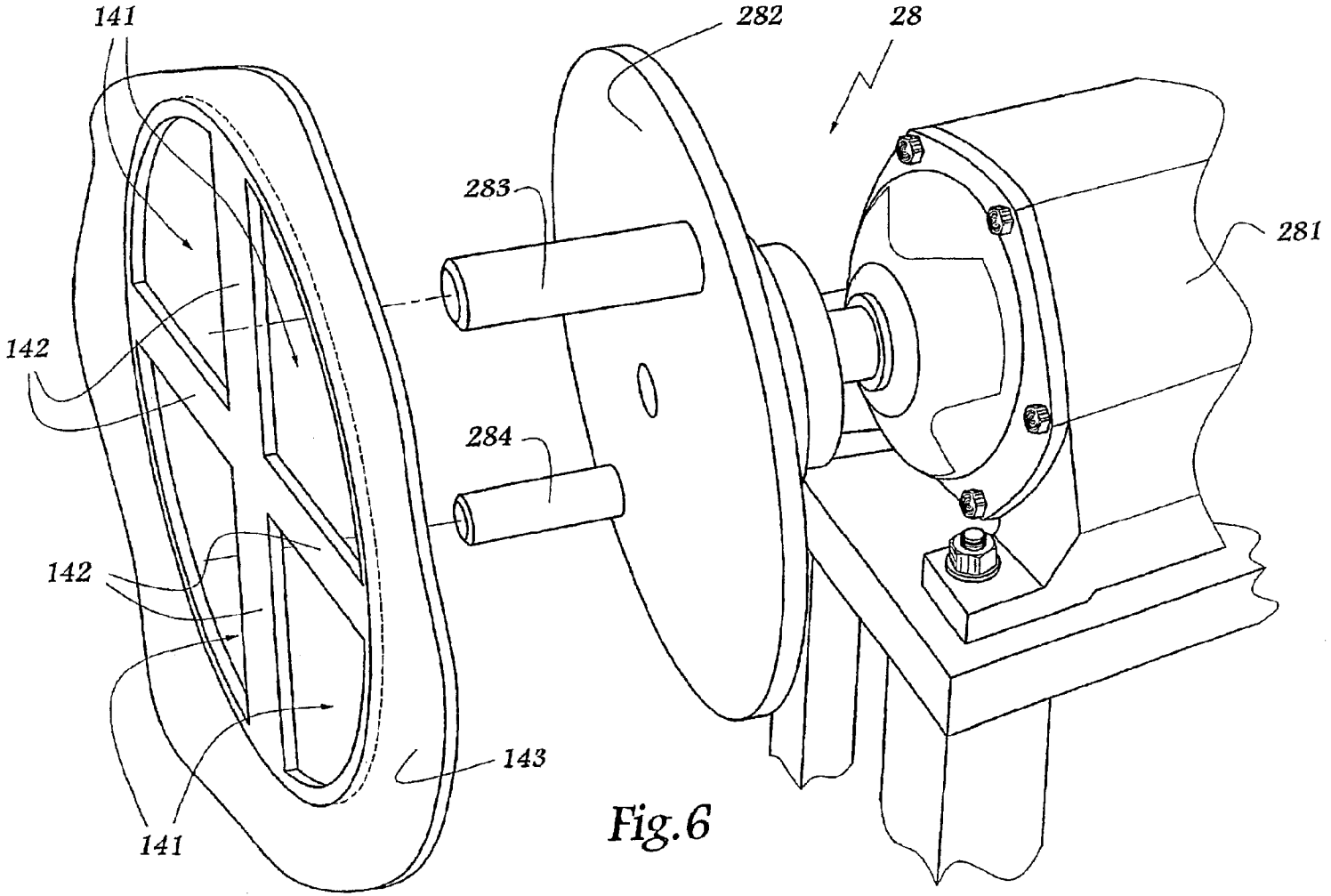
FIG. 6 is a schematic representation of the system for driving the coils used in the installation.

The drive system 28 of the coils 14 and 14' is shown solely in FIG. 6 in order to render the drawings clearer. It comprises an electric motor equipped with a gear motor 281 of which the driven shaft is coupled to a plate 282 provided with two fingers 283 intended to be introduced in openings 141 provided between bars 142 at the centre of each end plate 143 of the coils 14 or 14'. When the fingers 283 have been introduced in the openings 141 and when the motor 281 is activated, the fingers come into contact with two bars 142 on which they may exert a torque for rotation of the coil 14 or 14' in question.

The system 28 is mobile in directions $Y_1$–$Y'_1$, $Y_2$–$Y'_2$ and X–X', so that it may be alternately brought into engagement with one or the other of the coils 14 or 14'.

Figure 7:
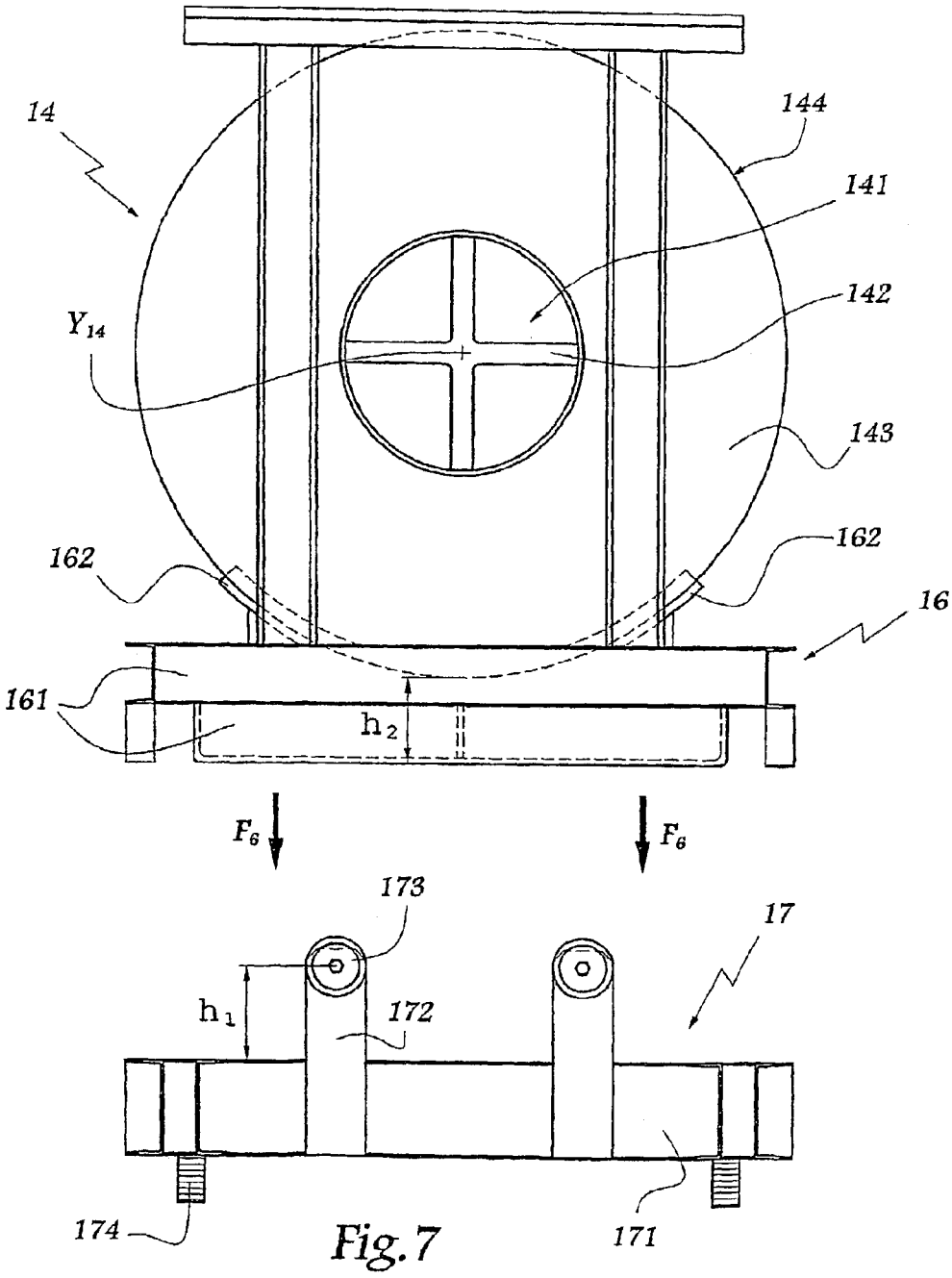
FIG. 7 is an exploded view, on a larger scale, of the elements located in a location of the installation.

Each coil 14 or 14' is supported by a chassis 16 or 16' formed by angles welded or assembled by bolting. The lower cross-ties 161 of the chassis 16 are of U-section, with webs of large thickness giving them a good dimensional stability, including when they are manipulated relatively suddenly with lift trucks. Each chassis 16 or 16' defines four shoes 162 in arc of cylinder form disposed level with the end plates 143 of the coils 14 and equivalent. By default, each coil 14 rests, by each end plate 143, on two shoes 162, so that, taking into account its weight and the forces of friction between the edges 144 and the side plates 143 and the shoes 162, the coil 14 is immobilized in rotation about its central axis $Y_{14}$. This corresponds to the position shown in FIG. 7 which is that of the coil l 4 when it must be stored or transported.

When the coil 14 is to be rotated about its axis $Y_{14}$, in particular for conditioning the sheet 2 or for unwinding it with a view to use thereof, the chassis 16 is installed, as represented by arrows $F_6$, on an auxiliary chassis 17 constituted by cross-ties 171 extending in substantially horizontal directions and from which supports 172 upwardly project, on which supports are idly mounted rollers 173 which are four in number and which are arranged so that, when the chassis 16 is placed on the chassis 17, the edges 144 of the end plates 143 rest on the rollers 173, being detached from the shoes 162. To that end, the height $h_1$ of the centres of the rollers 173 with respect to the upper face of the cross-ties 171 is greater than the height $h_2$ of the lower part of the edge 144 of the end plate 143 with respect to the lower surface of the cross-ties 161.

Each auxiliary chassis 17 is equipped with wheels 174 allowing it to slide, perpendicularly to the direction $F_1$ of advance of the sheet 2, on rails 7 extending in the floor of the installation in directions $Y_1$–$Y'_1$, and $Y_2$–$Y'_2$, as represented in FIG. 3.

Functioning is as follows: when an empty coil 14' is to be disposed in the location 15', the auxiliary chassis 17' intended for this location is taken into a position offset with respect to the zone of advance of the sheet 2, this position being shown in FIG. 3. In this position, a coil 14' installed in a chassis 16' is placed on the chassis 17', which makes it possible to release the possibility of rotation of this coil about its central axis while the coil 14' remains captive of the chassis 16'. The carriage 17' is then translated in the direction of the location 15', as represented by arrow $F_2$.

When a full coil is to be withdrawn from the installation, such as coil 14, the carriage 17 being intended for the location 15, the chassis 16 and the coil 14 are taken to the position represented in dashed and dotted lines in FIG. 3 and the simple fact of lifting the chassis 16 with respect to the chassis 17 makes it possible to immobilize the coil 14 in rotation inside the chassis 16 in question.

A system of indexing the position of the chassis 17 and 17' along the rails 7 may be provided by means of a finger 175 elastically loaded in the direction of the floor and adapted to be engaged in holes 8 provided in the ground at the level of the position of the chassis 17 and 17' in each of the locations 15 and 15' and in each of the positions of loading/unloading of the principal chassis on the auxiliary chassis.

The invention has been shown with two coils 14 and 14' disposed in two locations 15 and 15'. However, it is also applicable with three or more than three locations, the number of coils used being adapted accordingly without disturbing the functioning of the production line, particularly of the machine 1.

The invention has been described during its implementation with a sheet of SMC. However, it is applicable with other sheet moulding materials, such as mats or fiber fabrics.

What is claimed is:

1. Installation for coiling a sheet of molding material on coils at an exit of a machine for producing molding material in sheet form, the installation including:

at least two locations (15, 15') for positioning at least two coils (14, 14') for winding a sheet material (2), such locations being spaced in a substantially horizontal direction (X–X') from the exit end of the machine, a carriage (20) including a main frame (20A) and a secondary frame (20B) provided with rollers (22) for guiding said sheet material and reciprocally movable in translation ($F_4$) between a first position located substantially above a first of said at least two locations and a second position located substantially above a second of said at least two locations and said main (20A) and secondary (20B) frames being movable with respect to each other parallel to said horizontal direction (X–X').

2. Installation according to claim 1, wherein said carriage (20) includes a driving means (27) for driving said sheet material (2) toward said at least two coils, said said carriage carrying cutting means (26) for cutting said sheet material, said cutting means being moveable between a position of engagement with said sheet material and a position disengaged with respect to said sheet material.

3. Installation according to claim 2, wherein said driving means includes a frame (271) supporting a motorized roller (272) and a follower roller (273), said rollers each centered on an axis substantially perpendicular to a direction ($F_1$) of advance of said sheet material (2) and surrounded by a drive belt (275), while said frame (271) is articulated on said carriage 20 about an axis ($Y_{27}$) substantially perpendicular to said direction of advance, between a first position where said belt is in contact with said sheet material and a second position where said belt is remote from said sheet material.

4. Installation according to claim 1 wherein said carriage (20) carries a cutting device (26) mounted on a frame (261) articulated on carriage about an axis ($Y_{26}$) substantially perpendicular to said a direction of advance ($F_1$) of said sheet material (2).

5. Installation according to claim 1 wherein said carriage (20) includes a terminal guiding device (25) selectively movable relative to said carriage and from said carriage in a direction toward a coil (14, 14') said guiding device being articulated on said carriage so as to pivot about an axis ($Y_{25}$) which extends substantially perpendicular to a direction of advance ($F_1$) of said sheet material.

6. Installation according to claim 1 wherein said main (20A) and secondary (20B) frames carry rollers (22) for supporting said sheet material (2) in a direction of advance ($F_1$).

7. Installation according to claim 1 wherein said carriage (20) is moveable towards a standby position where it does not interfere with a path of a direction of advance ($F_1$) of said sheet material (2).

8. Installation according to claim 1 wherein each coil (14; 14') is mounted on a principal chassis (16, 16') on which it is adapted to rest, by way of peripheral edges (144) of end plates (143) on blocking shoes (162), and said principal chassis are adapted to be placed on auxiliary chassis (17, 17') provided with rollers (173) which lift said edges with respect to said shoes when said principal chassis are placed on said auxiliary chassis.

9. Installation according to claim 8, wherein each auxiliary chassis (17, 17') includes wheels (174) allowing it to slide in a direction ($Y1 - Y'_1$, $Y2 - Y'_2$) substantially perpendicular to a direction of advance ($F_1$) of said sheet material.

10. A method of coiling a sheet of molding material on coils at an exit of a machine for producing molding material in sheet form using at least two types of coils (4, 4', 14, 14') of different diameters at the exit of the machine depending upon a quantity of sheet material to be wound, the method including the steps of:

A. when coils (4, 4') of a relatively small diameter are to be used, coiling the sheet material on coils (4, 4') supported on a rocker (5) adjacent the exit of the machine;

B. when coils (14, 14') of relatively larger diameter are to be used, positioning at least two larger coils (14, 14') down stream and at spaced locations (15,15') with respect to one another, and spaced from the rocker in a horizontal direction (X–X') of advance of the sheet material;

C. providing a carriage (20) having a main frame (20A) and a secondary frame (20B) which is horizontally movable relative to the main frame and horizontally adjusting the carriage to a first position spaced from the coils (4, 4')so as to be substantially above one of the at least two coils (14, 14');

D. driving the sheet material from the carriage in order to displace the sheet material from the carriage to place the sheet material into contact with a mandrel (14*a*) of the one of the at least two coils (14, 14');

E. after a desired quantity of the sheet material is wound on the mandrel (14*a*), cutting the sheet material and thereafter moving the carriage to substantially above a second of the at least two coils (14, 14'); and thereafter F. driving the sheet material from the carriage and coiling the material on a manderal (14'*a*) until a desired quantity of sheet material is coiled thereon and thereafter cutting the sheet material.

* * * * *